United States Patent [19]

Bernatt et al.

[11] 4,263,572

[45] Apr. 21, 1981

[54] SHUNT TRIP MECHANISM FOR A CIRCUIT INTERRUPTING DEVICE

[75] Inventors: Joseph Bernatt, Casa Grande, Ariz.; Karel E. Vojta, Chicago, Ill.

[73] Assignee: S & C Electric Company, Chicago, Ill.

[21] Appl. No.: 951,681

[22] Filed: Oct. 16, 1978

[51] Int. Cl.[3] ..... H01H 73/00; H01H 75/02

[52] U.S. Cl. ..... 335/26

[58] Field of Search ..... 335/20, 21, 22, 26, 335/27, 172, 173, 174, 189, 190; 200/48 R

[56] References Cited

U.S. PATENT DOCUMENTS

| | | | |
|---|---|---|---|
| 1,193,695 | 8/1916 | Jacobs | 335/21 |
| 2,145,140 | 1/1939 | Starr | 335/21 X |
| 3,663,906 | 5/1972 | Barkan et al. | 335/195 |

*Primary Examiner*—Fred L. Braun

*Attorney, Agent, or Firm*—John D. Kaufmann

[57] ABSTRACT

A shunt trip mechanism includes a ratchet facility added to a self-contained, line potential stored-energy operating mechanism of a circuit interrupting device. Operation of the ratchet facility releases the stored energy to operate the device. A portion of the ratchet facility may also be operated to reset the device if it has previously been operated by either the shunt trip mechanism or the operating mechanism's current-responsive elements. The main portion of the shunt trip mechanism is at ground potential and is mechanically tied to and operates the ratchet facility by a movable insulated strut. The strut is moved by the shunt trip mechanism upon the occurrence of an event such as transformer overpressure. A ground level handle may be operated to reset the device whether it was operated by the operating mechanism or the shunt trip mechanism.

24 Claims, 14 Drawing Figures

82
64
80
84
74
70
62
92
72
90
76
88
79
86
202
4
4
206
96
220
218a
94
208
214b
218a
100
120
98
214a
222
118
116
110
114
112
108

105
98
97
106
78
102
104
94
96
100
96
94
79
210
204
208
206
202

SHUNT TRIP MECHANISM FOR A CIRCUIT INTERRUPTING DEVICE

BACKGROUND OF THE INVENTION

1. Field of the Invention

This invention relates to a shunt trip mechanism for a circuit interrupting device, and more specifically relates to a simple, reliable, inexpensive and reusable shunt trip mechanism for a bus-mountable, manually resettable circuit interrupting device, the shunt trip mechanism being at ground potential and being manually resettable.

2. Prior Art

An improved operating mechanism for a circuit interrupting device is disclosed and claimed in co-pending, commonly assigned U.S. patent application, Ser. No. 930,774, filed 8-3-78 in the name of Opfer and Vojta, and entitled, "Operating Mechanism for a Circuit Interrupting Device." Such co-pending, commonly assigned, U.S. patent application, is specifically incorporated by reference hereinto.

The above-referred to patent application discloses an operating mechanism of the type which renders a circuit interrupting device inexpensive and simple even though its interrupting capabilities are more limited than exotic, broad-range devices, such as circuit breakers, reclosers, and circuit switchers. Moreover, although more expensive than fuses, the circuit interrupting device with the operating mechanism of that patent application is reusable and is resettable from ground level and includes "intelligence" which senses the condition of the current in the circuit in which the device is connected. If overcurrents or fault currents occur which exceed some minimum value, but which are less than a maximum value, the interrupting capability of an interrupting unit of the device being within this range, the device is operating to interrupt the circuit. Fault currents or overcurrents in excess of the maximum value are not interrupted by the circuit interrupting device of that application, which in that event opens only after an upstream circuit breakers or similar device has interrupted the circuit.

The operating mechanism of the incorporated patent application is disclosed as usable with an interrupting unit having a pair of normally engaged, current-carrying contacts. The contacts are separable in an interrupting medium to interrupt the circuit. The operating mechanism includes a stored-energy operator and a tripping mechanism which selectively (1) prevent release of the stored energy to keep the contacts engaged, and (2) permit release of the stored energy to separate the contacts. The tripping mechanism includes a high mechanical advantage lever-link system which latches the stored energy when a low latching force is applied to the system. Also included is a movable member which in moving in a first direction stores energy capable of removing the low latching force, but otherwise leaves unaffected such low latching force. The member moves in a second direction solely under the influence of the stored latching-force-removing energy. A ratchet removes the low latching force from the lever-link system only when the movable member moves in the second direction.

The present invention relates to the minor modification or addition to the operating mechanism of the incorporated patent application, as well as to a novel shunt trip mechanism which is compatible with that operating mechanism and which furthers the ends and objects of the prior application, providing a simple, reliable, low-cost interrupting device, wherein fault interrupting ability is achieved at low cost.

As noted above, the prior application involves an operating mechanism for a circuit interrupting device. As used in this application, the term "operating mechanism" means a stored energy operator which selectively latches and releases stored energy in response to sensors which detect the condition of the current in circuit to which the circuit interrupting device is connected. Such operating mechanism and its intelligence is at line or bus potential. As used in this application, the term "shunt trip mechanism" refers to a mechanism at ground potential which is connected to or interacts with, the operating mechanism to operate the circuit interrupting device in response to any one of a number of conditions such as overpressure in a transformer, ground faults, or undesirable differential current condition in the transformer. Additionally, the shunt trip mechanism may be operated in response to a simple switch closure or push button operation for interruption of the circuit for any reason such as maintenance, repair, or inspection. As these two defined terms are used in this patent application, their ability to operate the circuit interrupting device is independent. Specifically, the operating mechanism has the ability of operating the circuit interrupting device, as described above, in response to overcurrents or fault currents within its operating capability, regardless of the condition of the shunt trip mechanism. Contrariwise, the shunt trip mechanism has the ability of operating the circuit interrupting device via the operating mechanism regardless of the current condition in the circuit to which the device is connected.

SUMMARY OF THE INVENTION

The present invention relates to a shunt trip mechanism especially useful for selectively operating a circuit interrupting device. The device is of the type which has an operating mechanism at line or bus potential which selectively (a) latches stored energy to maintain interrupting contacts normally closed, or (b) releases the stored energy to open the contacts in an interrupting medium in response to the predetermined condition of the current in the circuit, thereby interrupting the circuit.

The shunt trip mechanism of the present invention includes a first facility at line potential which selectively effects release of the stored energy by a portion of the operating mechanism to open the contacts independently of the current in the circuit. Additionally, the operation of the first facility may also reclose the open contacts and restore the energy to the operating mechanism upon such reclosing. Also included is a second facility at ground potential which is insulated from the operating mechanism and the first facility. The second facility operates the first facility to cause the release of the stored energy in response to the occurrence of a predetermined event. Typically, this event is something other than the condition of the current in the circuit which is being monitored by the operating mechanism. The second facility also operates the first facility to reclose the open contacts and to restore the energy in response to manual manipulation of the second facility, regardless of whether the stored energy was released by operation of the operating mechanism itself, or by operation of the first and second facilities.

GENERAL-FIG. 1

Figure 1:
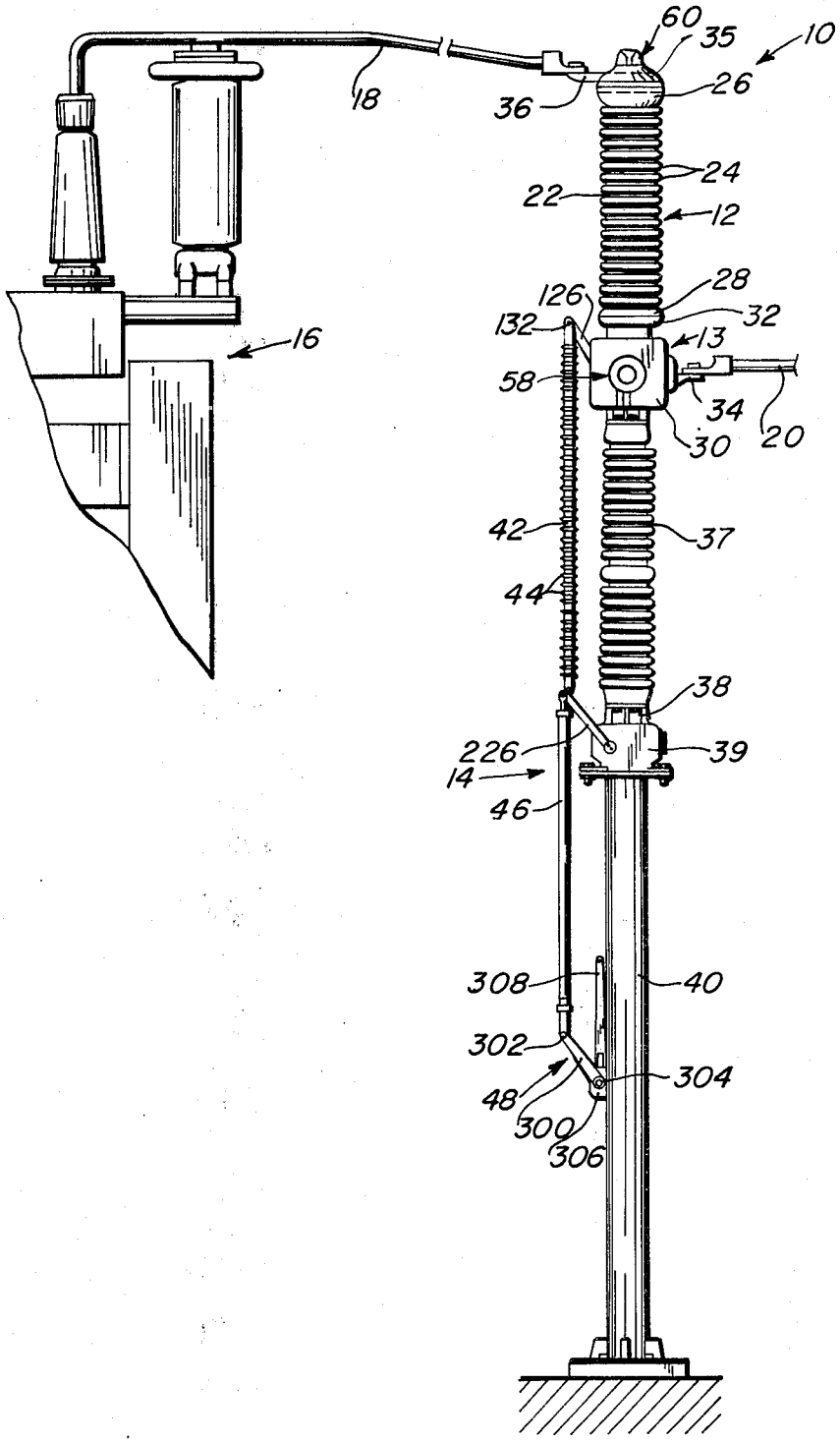
FIG. 1 is a side elevation of a vertically-oriented circuit interrupting device including an interrupting unit, an operating mechanism and a novel shunt trip mechanism therefore, according to the present invention.

Referring to FIG. 1, there is shown a circuit-interrupting device 10 comprising an interrupting unit 12, an operating mechanism 13 and a novel shunt trip mechanism 14 according to the present invention. The interrupting unit 12 may be any known type, such as those shown in commonly assigned U.S. Pat. Nos. 3,030,481, issued 4/17/62; 3,163,736, issued 12/29/64; 3,508,022, issued 4/21/70 and 3,769,477 issued 10/30/73. Both the interrupting unit 12 and its operating mechanism 13 are more fully described in co-pending, commonly-assigned U.S. patent application Ser. No. 930,744, filed on 8/3/78, in the names of Opfer and Vojta, which is specifically incorporated by reference hereinto. The interrupting device 10 can interrupt a circuit to provide protection for a transformer 16 in the event of fault currents or overcurrents, and has the ability to interrupt the circuit to which the transformer 16 is connected during normal current conditions; i.e., when load or magnetizing currents are flowing. Preferably, as shown in FIG. 1, the device 10 is oriented so that the interrupting unit 12 is vertically mounted between buses 18 and 20 constituting one phase of a three-phase circuit supplying power to the transformer 16. Additional devices 10 may be connected in the other two phases of the circuit. The device 10 may also be oriented so that the interrupting unit 12 is horizontally mounted between the buses 18 and 20, or in any other orientation.

As more fully disclosed in the co-pending, commonly-assigned patent application to Opfer and Vojta, the transformer 16 is downstream of the device 10 which is connected thereto by the bus 18. Upstream of the interrupting device 10 and connected in the bus 20 between a power source (not shown) and the device 10 is a circuit breaker (not shown) or other broad range fault-interrupting device which opens the circuit 18,20 to the transformer 16 should an overcurrent or fault occur which is not interrupted by the device 10. The interrupting unit 12 of the device 10 has a limited fault current interrupting rating. That is, the interrupting unit 12 is designed to open the circuit 18,20 to the transformer 16 should overcurrents or fault currents within a predetermined range occur, but is unable to, and accodingly does not attempt to, interrupt overcurrents or fault currents in excess of the maximum of this range. This selective operation of the interrupting unit 12 is effected by the operating mechanism 13, which is more specifically described and claimed in the aforementioned co-pending, commonly-assigned patent application. In sum, the operating mechanism 13 responds to conditions in the circuit 18,20 to selectively operate the interrupting unit 12 only within the rating thereof.

The present invention more specifically relates to the shunt trip mechanism 14, to be hereinafter described in detail, which permits operation of the interrupting unit 12 for a wide variety of reasons and under a wide variety of conditions other than fault currents or overcurrents in the circuit 18,20. Examples of conditions which may cause the shunt trip mechanism 14 to operate the interrupting unit 12 independently of the operating mechanism 13 are overpressure in the transformer 16, ground faults, and undesirable differential current conditions in the transformer 16. The shunt trip mechanism 14 may also operate the interrupting unit 12 to intertupt and open the circuit 18,20 for any other reason, such as for general maintenance or inspection of the circuit 18,20, the transformer 16, the upstream circuit breaker, etc.

As noted earlier, a full description of the interrupting device 10 as operated by the operating mechanism 13 is given in the co-pending patent application of Opfer and Vojta. The operating mechanism 13 of that application and the shunt trip mechanism 14 of this application are intended to represent two phases of a "building block" approach, enabling users of the circuit interrupting device 10 to tailor such device 10 to the needs of their circuit 18,20 and to the rest of their electrical system. Specifically, the user may opt to purchase and use the interrupting device 10 with only the operating mechanism 13 of the co-pending patent application to provide single-pole protection of the transformer 16. In this event, the operating mechanism 13 provides sensing of the condition of the current in the buses 18 and 20 connected to the transformer 16 and between which the interrupting device 10 is mounted. Operation of the interrupting device 10 in that event depends solely on the character of the current flowing in the buses 18 and 20. On the other hand, the user may opt to purchase the interrupting device 10 including both the operating mechanism 13 and the shunt trip mechanism 14 of the present invention. In this event, in addition to operation of the interrupting device 10 based on the condition of the current in the buses 18 and 20, the user achieves the ability to interrupt current in the buses 18 and 20 as a result of a "relaying scheme" (not shown) which may sense one or more of the wide variety of conditions noted above, including overpressure in the transformer 16. The user's "relaying scheme" in this case is connected to the shunt trip mechanism 14, as fully set forth below. Thus, the interrupting device 10 when provided with both mechanisms 13 and 14, beside protecting the transformer 16 from overcurrents, also provides for interruption of the circuit 18,20 independently of the condition of the current in the circuit 18,20. Lastly, the user may opt to purchase the interrupting device 10 having a modified form of the operating mechanism 13 of the co-pending patent application in which the ability of the mechanism 13 to sense current in the buses 18,20 is not present. That is, the sole manner of causing the operating mechanism 13 to open the interrupting unit 12 is the shunt trip mechanism 14. In this event, the user's relaying scheme could be set up to detect not only those conditions noted above, but also overcurrent in the circuit 18,20.

As will hereinafter more fully be described, the shunt trip mechanism 14 of the present invention is at ground potential, not a line potential as is the operating mechanism 13 of the co-pending patent application. As a consequence, the "building block" approach noted above provides the user with the following options: (1) bus or line potential sensing of overcurrents and fault currents; (2) two parallel methods of operating the interrupting device 10, namely bus or line potential fault current or overcurrent sensing and ground potential sensing of other conditions, either method being independently capable of operating the interrupting device 10; and (3) ground potential sensing of a variety of conditions without line or bus potential sensing of overcurrent conditions.

Referring again to FIG. 1, the interrupting unit 12 includes an elongated, generally cylindrical, insulative interrupting unit housing 22. The interrupting unit housing 22 is hollow, is made of porcelain or other insulative material, and may include a plurality of skirts 24 for increasing the leakage distance over the outside thereof, as is well known. Affixed by cementing or the like to the ends of the interrupting unit housing 22 are metal mounting flanges 26 and 28. A metal operating mechanism housing 30 is mounted to one end of the interrupting unit housing 22 by attaching an integral mounting flange 32 thereon to the mounting flange 28 by bolts or the like. The operating mechanism housing 30 includes a conductive terminal pad 34 at right angles to the axis of the interrupting unit housing 22 and connected by appropriate facilities to the bus 20. The mounting flange 28 seals one end of the interrupting unit housing 22.

Mounted by bolts or the like to the mounting flange 26 at the upper end of the interrupting unit housing 22 is a metal end plate 35 which seals such other end of the interrupting unit housing 22. A conductive terminal pad 36 at right angles to the axis of the housing 22 and integral with the end plate 35 is connected in FIG. 1 by appropriate facilities to the bus 18. The device 10 is thus connected in series between the transformer 16 and the upstream circuit breaker (not shown) and the further upstream power source (not shown).

The device 10 is supported by an insulator stack 37 which in turn is supported by a mounting flange 38 attached to or formed integrally with a metal housing 39 for the shunt trip mechanism 14. The shunt trip mechanism housing 38 is in turn supported by a support column 40.

An insulative strut 42 is connected between the shunt trip mechanism 14 and the operating mechanism 13, as more fully described below. The strut 42 is made of porcelain or other insulative material and may include a series of leakage distance-increasing skirts 44, as is well known. As described subsequently, operation of the shunt trip mechanism 14 moves the strut 42 to selectively operate the operating mechanism 13 thereby operating the interrupting unit 12. Connected to the shunt trip mechanism 14 is also a generally vertical operating member 46 such as pipe or the like. The pipe 46 is selectively movable by a ground level handle assembly 48. As more fully explained below, operation of the handle assembly 48 moves the pipe 46 to affect the condition of the shunt trip mechanism 14 and also to move the strut 42 to affect the condition of the operating mechanism 13.

INTERRUPTING UNIT 12-FIG. 1

Generally, the interrupting unit 12 may be of the type more specifically described and explained in the above-referred-to co-pending U.S. patent application of Opfer and Vojta. The interrupting unit 12 itself forms no part of the present invention.

The interrupting unit 12 is of the general type wherein a pair normally engaged, relatively movable and separable contacts (not shown) within the interrupting unit housing 22 are mounted for movement into and out of engagement with each other. Preferably, one contact is movable while the other contact is stationary, although both contacts may be movable. Further, separation of the contacts takes place in the presence of an arc-extinguishing medium such as $SF_6$ gas contained within the interrupting unit housing 22. Such separation, with or without "puffing" action, effects circuit interruption and extinguishment of the arc formed between the separated contacts. The contacts may take any preferred form, shape, location and orientation. The operating mechanism 13 rapidly, selectively separates the contacts.

The stationary contact may be electrically connected to the mounting flange 26 by a conductive member (not shown). Thus, a first continuous electrical path is formed as follows: the bus 18, the terminal pad 36, the end plate 36, the flange 26, the conductive member, and the stationary contact. The movable contact is mounted to a conductive, reciprocable operating rod 56 (See FIG. 2) which is parallel to the axis of the interrupting unit housing 22. Selective movement or reciprocation of the rod 56 by the operating mechanism 13, as briefly described herein and as more fully described in the co-pending U.S. application of Opfer and Vojta, moves the movable contact. One or more sliding contacts (not shown) may be arranged to electrically contact the operating rod 56 regardless of its position. Such sliding contacts are continuously electrically connected to the flange 28. Thus, a second continuous electrical path is formed as follows: the bus 20, the terminal pad 34, the operating mechanism housing 30, the flange 32, the flange 28, the sliding contacts, the operating rod 56 and the movable contact. When the contacts are engaged (the device 10 is "closed"), a continuous electrical path through the device 10 and between the buses 18 and 20 is formed. The shunt trip mechanism 14 is insulated from this electrical path by both the insulator stack 37 and the insulative strut 42. Should an overcurrent or fault current within the rating of the device 10 occur, or should there be some other reason making it desirable to operate the device 10, the operating mechanism 13 rapidly moves the operating rod 56 down (in FIGS. 1 and 2) to move the movable contact away from the stationary contact. This movement rapidly elongates the arc established between the contacts. Such rapid arc elongation and the action of the $SF_6$ gas extinguish the arc, as is well known.

The presence of a medium such as $SF_6$ in the unit housing 22 may necessitate sealing of the ends thereof. To this end, the end plate 35 or the flange 26 may be provided with appropriate seals, "0" rings or the like (not shown). The movement of the operating rod 56 in both housings 22 and 30 necessitates a different sealing arrangement associated with the flange 28. Specifically, a flexible bellows (not shown) surrounding the operating rod 56 may be sealed at one end to the flange 28 and at the other end to the operating rod 56 within the housing 22. Thus, the operating rod 56 is free to move while the bellows prevents leakage of the $SF_6$ therepast into the operating mechanism housing 30.

The operating mechanism housing 30 may have a contact position indicator shown only generally at 58 for indicating to an operator at ground level that the contacts have opened and are not in engagement. The end plate 35 may have a pressure-indicating device and/or a pressure-relief device generally indicated at 60. The device 60 may indicate whether the pressure of the $SF_6$ (where used) within the interrupting unit housing 22 is proper and may also vent the interior of the normally sealed housing 22 to atmosphere in the event of an overpressure therewithin.

Figure 2:
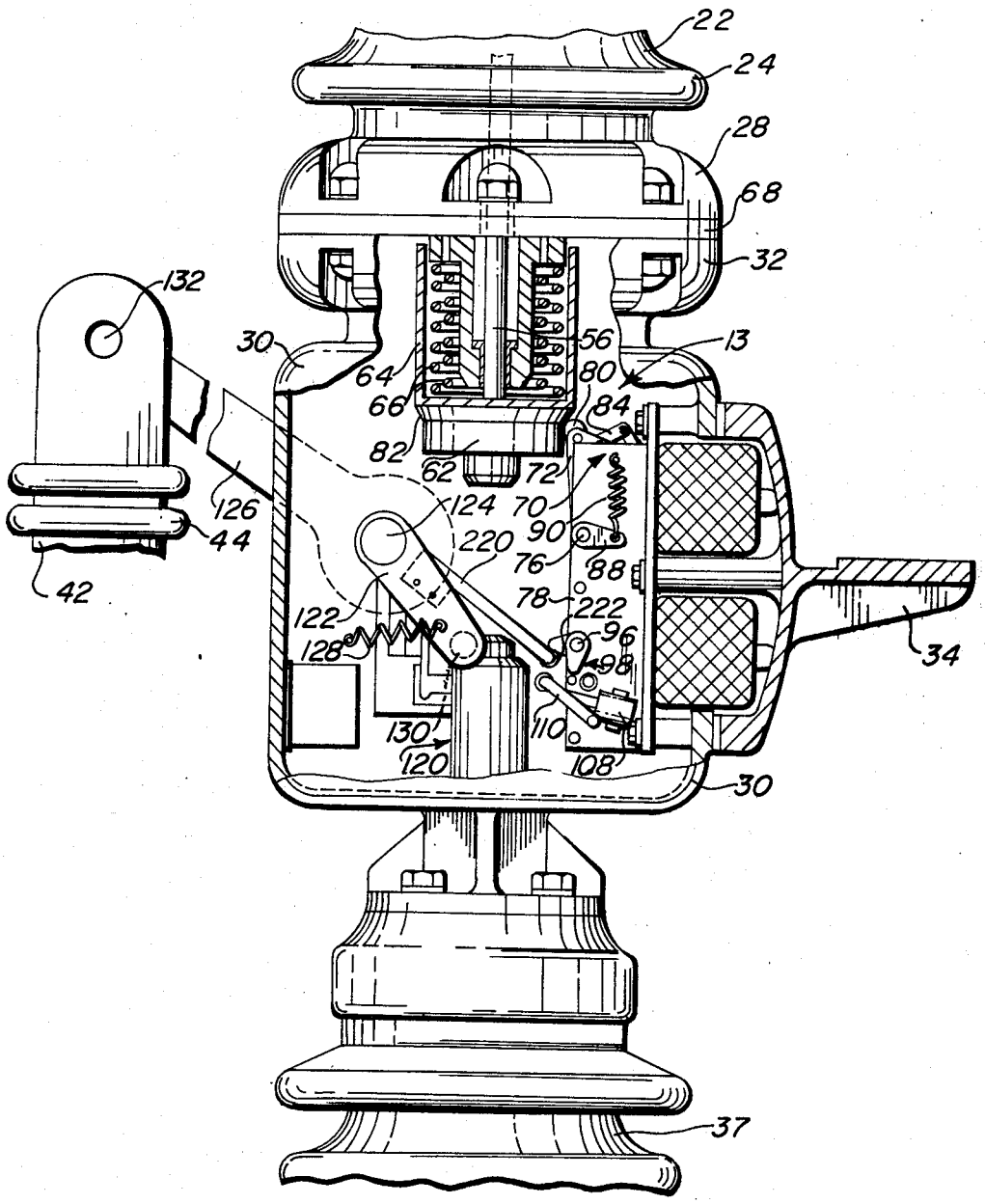
FIG. 2 is a side elevation, partially sectioned view of the operating mechanism for the circuit interrupting device of FIG. 1 in accordance with the present invention.
Figure 3:
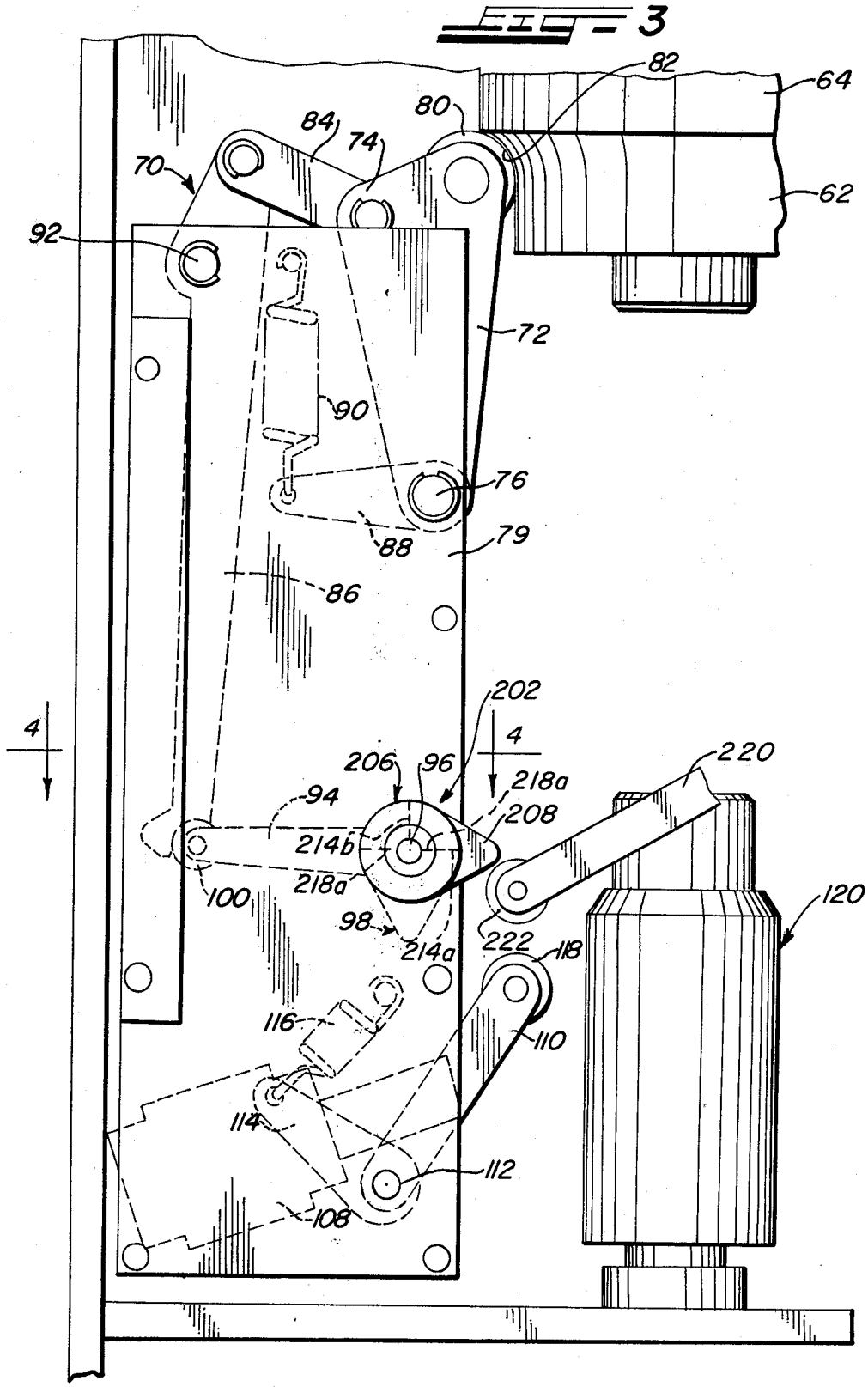
FIG. 3 is an enlarged view, taken from the rear of FIG. 2, of a portion of the operating mechanism of FIG. 2 showing in detail the various elements thereof.
Figure 4:
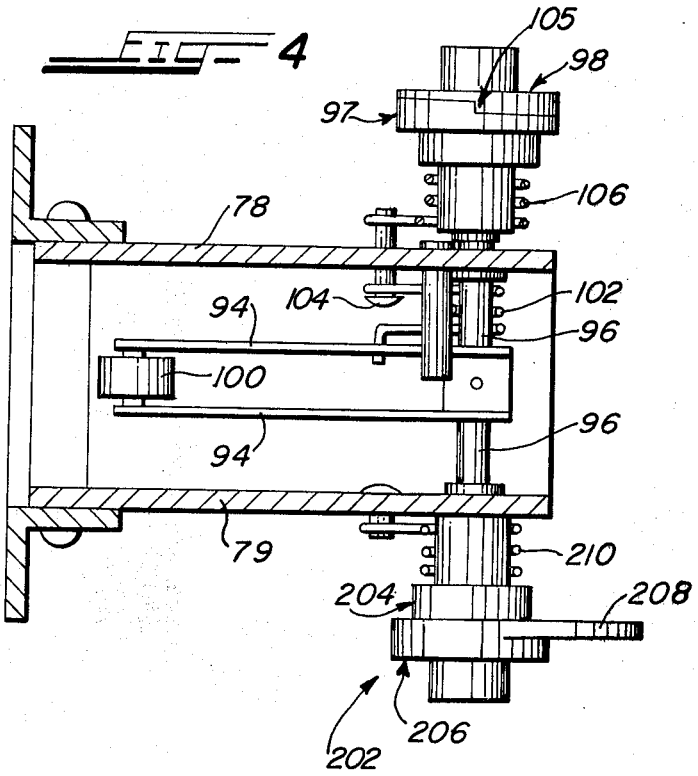
FIG. 4 is a sectional, side elevation of a portion of the operating mechanism shown in FIG. 3 taken along line 4—4 of FIG. 3.

OPERATING MECHANISM 13 - FIGS. 2,3 and 4

The operating mechanism 13 is here described only generally, a more complete description thereof being given in the co-pending application of Opfer and Vojta. The operating rod 56 passes into the operating mechanism housing 30 and is connected to an end member 62 of a movable spring-confining tube 64. The spring-confining tube 64 contains one or more nested coil springs 66 acting between the end member 62 and a wall 68 which may be attached to or formed integrally with the mounting flange 28 or the mounting flange 32. The coil springs 66 are shown in a compressed state in FIGS. 2 and 3. If the spring-confining tube 64 is free to move, it will do so rapidly due to the robust nature of the springs 66 and will move the operating rod 56 down (in FIG. 2) to move the movable contact away from the stationary contact. Normally, such movement of the tube 64 is prevented by a lever-link system 70.

The lever-link system 70 includes a pivotable lever 72 having an offset portion 74. One end of the lever 72 is mounted to a shaft 76 jornalled for rotation in a pair of parallel upstanding support plates 78 and 79 (only the former being visible in FIG. 4). The support plates 78 and 79 may be attached to the operating mechanism housing 30 in any convenient manner. The end of the lever 72 opposite the shaft 76 carries a roller 80. The roller 80 is configured to conform to a rounded taper 82 formed in the surface of the end member 62. The offset 74 is pivotally connected to a link 84 at one end thereof, the other end of the link 84 bing pivotally connected to one end of a class 1 lever 86. Normally, when the coil springs 66 are compressed, the roller 80 is positioned to engage the rounded taper 82. If the lever 72 is held stationary in the position shown in FIGS. 2 and 3, the engagement between the roller 80 and the rounded taper 82 prevents movement of the spring-confining tube 64 thereby latching the energy stored in the coil springs 66 to prevent movement apart of the contacts.

Also connected to the shaft 76 is a return arm 88 which is biased by a return spring 90 connected to one of the support plates 78. The return spring 90 thus biases the arm 72 to the position shown in FIGS. 2 and 3.

The lever 86 is pivoted as at 92 at a point much closer to the pivotal connection of the link 84 thereto than to the remote end of the lever 86. The remote end of the lever 86, if held in the fixed position shown in FIGS. 2 and 3, holds fixed the end of the lever 86 which is closer to the pivot 92, thus propping the link 84 in the position shown. This propping of the link 84 maintains the lever 72 in the position shown and further maintains the roller 80 in contact with the rounded taper 82 on the end member 62, thus preventing release of the potential energy stored in the coil springs 66. Such holding of the remote end of the lever 86 is effected by an arm 94 fixed to a shaft 96 which is journalled for rotation in the support plates 78 and 79. Also mounted to the shaft 96 is a drive member 97 (visible only in FIG. 4) which together with a flipper member 98 constitutes a type of one-way ratchet mechanism for selectively moving the shaft 96 to rotate the arm 94. The arm 94 has a roller 100 mounted at one end thereof which normally engages a mating surface formed in the remote end of the lever 86. In the position shown in FIGS. 2 and 3, the arm 94 applies a low latching force to, and keeps from rotating, the remote end of the lever 86. This, in turn, prevents rotation of the end of the lever 86 nearer to the pivot 92, accordingly maintaining the link 84 in the propped position, thus permitting the roller 80 to maintain the potential energy in the springs 66 latched. The arm 94 moves with the drive member 97. Also, the arm 94 is biased to the position shown in FIGS. 3 and 4 by a return spring 102 (FIG. 4) acting between the arm 94 and a pin 104 attached to one of the support plates 78.

As more fully described in the co-pending application of Opfer and Vojta, both the flipper 98 and the drive member 97 contain projections or teeth, generally indicated at 105 (FIG. 4) which interact so that counterclockwise rotation of the flipper 98 as viewed in FIG. 2 (clockwise in FIG. 3) has no effect on the position of the drive member 97. After such rotation of the flipper 98, a return spring 106 (FIG. 4) acting between the flipper 98 and the pin 104 returns the flipper 98 to the position shown in FIGS. 2 and 3. Clockwise rotation of the flipper 98 in FIG. 2 (counterclockwise in FIG. 3) brings the respective teeth 105 of the flipper 98 and the drive member 97 into engagement to rotate the drive member 97 and the shaft 96 in the clockwise direction (counterclockwise in FIG. 3). Such rotation of the shaft 96 rotates the arm 94 counterclockwise as shown in FIG. 3 (clockwise in FIG. 2) to remove the roller 100 from its engagement with the remote end of the arm 86. This action permits the potential energy stored in the coil springs 66 to move the roller 80 out of the rounded taper 82 and to release this energy for the purpose of moving the tube 64, the operating rod 56 and the movable contact. This action is achieved by rotating the lever 72 about the shaft 76 clockwise as viewed in FIG. 2 and counterclockwise as viewed in FIG. 3. This movement of the lever 72 is accompanied by movement of the link 84 and by clockwise rotation of the lever 86 about the pivot 92 (counterclockwise in FIG. 3).

Also included in the operating mechanism of the co-pending application of Opfer and Vojta is a solenoid 108 mounted to one of the support plates 78 and connected to an arm 110. The arm 110 is fixed to a shaft 112 which is journalled for rotation in the support plates 78 and 79 A return arm 114 is mounted to the shaft 112. Attached between the plate 78 and the return arm 114 is a return spring 116 which biases the arm 110 to the position as shown in FIGS. 2 and 3.

When appropriate sensing apparatus (not shown, but more completely described in co-pending application of Opfer and Vojta) senses an overcurrent in the circuit 18,20, an appropriate signal is transmitted to the solenoid 108 to cause counterclockwise rotation (in FIG. 3) of the arm 110. This rotation of the arm 110 brings a roller 118 mounted on the end thereof into contact with the flipper 98. The arm 110 moves past the flipper without affecting the position of the drive member 97, as described above. If the fault or overcurrent condition sensed in the circuit 18,20 is within the rating of the interrupting unit 12, the solenoid 108 is immediately de-energized and the return spring 116 immediately returns both the return arm 114 and the arm 110 to their initial position. Movement of the arm 110 back to its initial position moves the roller 118 into contact with the flipper 98 rotating the drive member 97 to move the roller 100 on the arm 94 out of engagement with the remote end of the lever 86. This action releases the energy stored in the coil springs 66 so that the contacts are separated. If the overcurrent or fault current sensed in the circuit 18,20 exceeds the rating of the interrupting unit 12, the solenoid 108 is maintained energized, holding the arm 110 in its rotated position until the upstream breaker or other protective device interrupts the circuit 12,20. At this time, as the current reaches or nears zero, the solenoid 108 is de-energized, permitting the return spring 116 to move the arm 110 back, effecting separation of the contacts and serving an isolating, rather than an interrupting, function for the circuit 18,20.

A summary of the Opfer-Vojta invention follows: The high stored energy of the springs 66 is normally counteracted by a low latching force applied by the arm 94 to one end of the lever 86 which constitutes an element in the lever-link system 70. This counteraction continues as long as the arm 110 remains in its normal position or moves past the flipper 98 (counterclockwise in FIG. 3) from such normal position due to energization of the solenoid 108. Such movement of the arm 110 past the flipper 98 leaves unaffected the low-latch-force-applying condition of the arm 94, but stores energy in the spring 116 capable of removing the low latching force. Once the solenoid is de-energized, the spring 116 moves the arm 110 back to its normal position, rotating both the flipper 98 and the drive member 97 to rotate the lever 94. Such rotation of the lever 94 removes the low latching force from the lever-link system 70, permitting the springs 66 to separate the contacts within the housing 22.

The operating mechanism 13 also includes a shock absorber, only generally designated at 120, for stopping the tube 64 without transmitting violent shock to any of the other elements of the operating mechanism 13.

The operating mechanism 13 disclosed in the co-pending application of Opfer and Vojta also contains a reclosing facility which includes a pair of reclosing arms 122 (FIG. 2) carried on a shaft 124 which is journalled for rotation in the operating mechanism housing 30. Also connected to the shaft 124 is a handle 126 (FIGS. 1 and 2). Rotation of the handle 126 rotates the shaft 124 to rotate the reclosing arms 122. The reclosing arms 122 straddle the shock absorber 120 and are maintained in the position shown in FIG. 2 by a return spring 128. When it is desired to reclose the contacts and restore energy in the operating springs 66 following separation of the contacts, the handle 126 is rotated is a counterclockwise direction, as viewed in FIG. 2, to rotate the reclosing arms 122. Such rotation of the reclosing arms 122 brings studs 130 on the ends thereof against the end member 62. Further rotation of the handle 126 moves the end member 62 and the tube 64 upwardly, as viewed in FIG. 2, until the roller 80, under the influence of the return spring 90, re-enters the rounded taper 82 to relatch the potential energy stored in the coil springs 66. In the co-pending patent application, the handle 126 is operable from ground level by an insulated pole or hookstick manipulated by a human operator. In the present invention, the handle 126 is present, but, rather than being engageable by a hookstick, is pivotally connected to the top end of the insulative strut 42 at a pivot point 132 (FIGS. 1 and 2).

It should be noted that in preferred embodiments of both this invention and the invention disclosed in the co-pending application of Opfer and Vojta, the reclosing arms 122 can be rotated a limited amount, such as 15°, without positioning the studs 130 in the path of the end member 62. This prevents high forces and shock from being applied to the reclosing arms 122, the handle 126 and the strut 42 in the event such limited rotation takes places before, or simultaneously with, downward movement of the tube 64 and the end member 62.

SHUNT TRIP MECHANISM 14—FIGS. 1-5

One addition or change is necessary to the operating mechanism 13 disclosed and claimed in the application of Opfer and Vojta to render the operating mechanism 13 usable with the shunt trip mechanism 14 of the present invention. Specifically, the shaft 96 to which both the drive member 97 and the arm 94 are mounted, is extended into the plane of FIG. 2, out of the plane of FIG. 3, and downwardly in FIG. 4. It will be recalled that as viewed in FIG. 3, counterclockwise rotation of the flipper 98 rotates the shaft 96 counterclockwise to move the arm 94 away from the remote arm of the lever 86, freeing the energy stored in the coil springs 66. Contrariwise, clockwise rotation of the flipper 98 has no effect on the position of the shaft 96. The shaft 96 may accordingly contain on its extension a one-way ratchet 202 which is similar to the one-way ratchet made up of the flipper 98 and the drive member 97 already found in the operating mechanism 13.

Figure 5A:
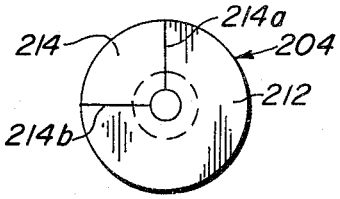
FIGS. 5A and 5B are enlarged views of two elements of the operating mechanism depicted in FIGS. 2 through 4 according to the present invention.
Figure 5B:
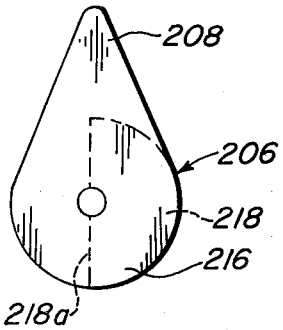

Referring to FIGS. 3-5, the one-way ratchet 202 includes a shaft rotating or drive member 204 fixed to the extended shaft 96. From the perspective of FIG. 3, counterclockwise rotation of this member 204 (not visible in FIG. 3) rotates the shaft 96 counterclockwise to move the arm 94 and its roller 100 out of the path of the remote end of the lever 86, thus releasing the stored potential energy of the coil springs 66. Freely mounted about the shaft 96 is a flipper 206 which contains an extension 208. The extension 208 is maintained in its normal position shown in FIGS. 2-4 by a coil spring 210 surrounding the extended shaft 96 and acting between the flipper 206 and one of the support plates 79, as best seen in FIG. 4. The drive member 204 is held in its normal position by the spring 102.

Referring now to FIG. 5, the drive member 204 and flipper 206 are shown disassociated from the extended shaft 96 but in a similar perspective as presented in FIG. 3. The drive member 204 comprises a generally cylindrical body 212 having on its front surface a raised protrusion or tooth 124 which contains in the normal position of the drive member 204 a vertical surface 214*a* (horizontal in FIG. 3) and a horizontal surface 214*b* (vertical in FIG. 3), the surface 214*b* being approximately 90° counterclockwise away from the surface 214*a*. By the same token, the flipper 206 may be seen to comprise a generally cylindrical body 216 having a raised protrusion or tooth 218 on the back surface thereof. The tooth 218 contains in the normal position of the flipper 206 a vertically oriented surface 218*a* (horizontally oriented in FIG. 3). As viewed in FIG. 3, the drive member 204 is behind the flipper 206. The coil spring 210 (FIG. 4) normally maintains the flipper in the orientation shown in FIGS. 3 and 4. The return spring 102 FIG. 4 maintains the surfaces 214*a* and 214*b* of the tooth 214 in the orientation shown in FIG. 3. It may be seen from FIG. 3 that the flipper 206 and its extension 208 are free to rotate in a clockwise direction without affecting the position of either the drive member 204 or of the shaft 96. Specifically, clockwise rotation of the extension 208 carries the surface 218*a* of the tooth 218 away from the surface 214*a* of the tooth 214. Contrariwise, should the flipper 206 rotate counterclockwise due to counterclockwise rotation of the extension 208, the surface 218*a* normally in engagement with the surface 214*a* forces the tooth 214 and the drive member 204 to rotate in a counterclockwise direction, thus rotating the shaft 96 in that same direction to move the roller 100 out of engagement with the remote end of the lever 86. The one-way ratchet 202 herein described is similar in operation to, and, except for its positioning on the shaft 96, is structured the same as the corresponding drive member and flipper 97 and 98, described more fully in patent application of Opfer and Vojta.

As shown in FIGS. 2 and 3, one of the reclosing arms 122 has attached thereto an extension 220 which depends therefrom toward the one-way ratchet 202. The extension 220 includes at its lowermost end a roller 222 which upon rotation of the reclosing arms 122 (counterclockwise in FIG. 2, clockwise in FIG. 3) moves against the extension 208 and rotates the flipper 206 (clockwise in FIG. 2; counterclockwise in FIG. 3). Thus, it may be seen be reference to FIG. 3, that some limited clockwise rotation of the reclosing arm 122 permits the extension 220 to rotate clockwise and permits unlatching of the potential energy stored in the coil springs 66 due to the counterclockwise rotation of the flipper 206 and the drive member 204. As noted earlier, the reclosing arms 122 may be rotated a limited amount, typically 15°, without any danger that the studs 130 thereon will be placed in the path of the end member 62.

Turning now to FIGS. 2 and 3, it may be seen that rotation of the extension 220 (counterclockwise in FIG. 2; clockwise in FIG. 3), which effects operation of the one-way ratchet 202 to release the potential energy stored in the springs 66, may be effected by appropriate counterclockwise rotation (in FIG. 2) of the handle 126. Such rotation of the handle 126 is, in turn, caused by downward movement of the insulated strut 42. As noted earlier, the insulated strut 42 is connected to the shunt trip mechanism 14 of the present invention. Suffice it here to say that the shunt trip mechanism 14 may be so operated that the insulated strut 42 is moved downwardly a limited amount to rotate the handle 126 a limited amount, bringing the roller 222 into contact with the one-way ratchet 202 to effect operation of the interrupting unit 14. This limited rotation (approximately 15°) of the handle 126 and of the extension 220 is such that the reclosing arms 122 and their studs 130 are not placed in the path of the end member 62, as described earlier.

As used in certain claims hereof, "movable means" refers to the reclosing arms 122 (and their studs 130), the extension 220 carried by one of the arms 122 (and the roller 222 on the extension 220), and elements associated therewith, and, of course, equivalents of all of these elements. As previously described, if the strut 42 is moved down to rotate the handle 126 and the shaft 124 counterclockwise a first predetermined amount—say, about 15°—against the action of the return spring 128, the extension 220 also rotates such first predetermined amount and the roller 222 operates the one-way ratchet 202 to release any energy stored in the spring 66 without positioning the studs 130 in the path of the end member 62. If the handle 126 and the shaft 124 are rotated counterclockwise a second predetermined amount—more than 15°—the studs 130 reclose the interrupting unit 12 and restore energy in the springs 66 as previously described. Also as used in certain claims, "electrically insulative means" refers to all of the above elements in combination with the strut 42, and equivalents, whereas "insulated means" refers to the strut 42 as it interconnects various elements of the operating mechanism 13 (including the arms 122, the extension 220 and the one-way ratchet 202) and the shunt trip mechanism 14, as well as elements connected to or coacting with the strut 42.

STRUCTURE OF SHUNT TRIP MECHANISM 14—FIGS. 1, 6 AND 7

Figure 6:
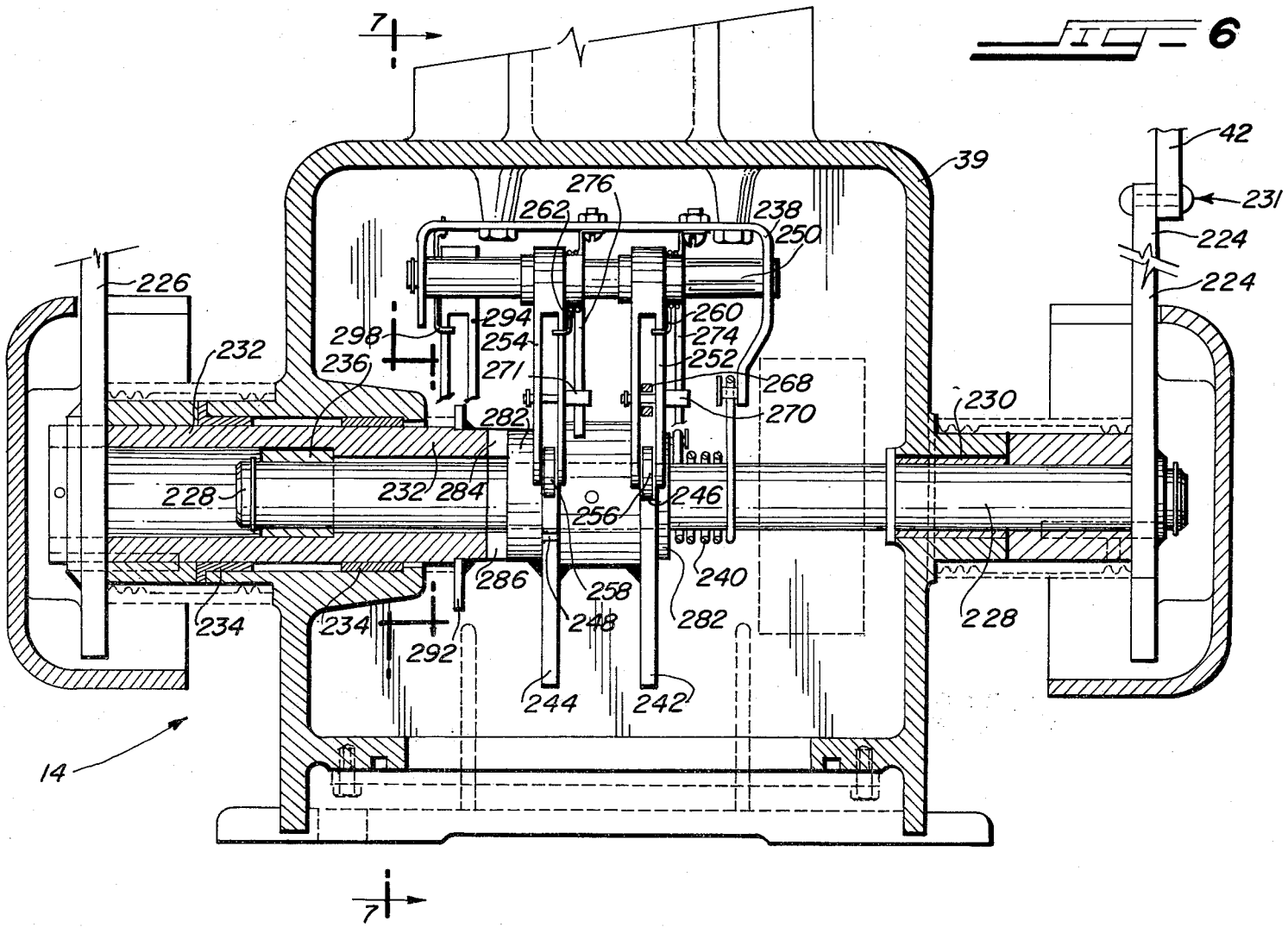
FIG. 6 is a side elevation, partially sectioned view of the novel shunt trip mechanism according to the present invention which is generally depicted in FIG. 1; certain elements of the novel shunt trip mechanism have been deleted from the figure in order to facilitate a depiction of important features thereof.
Figure 7:
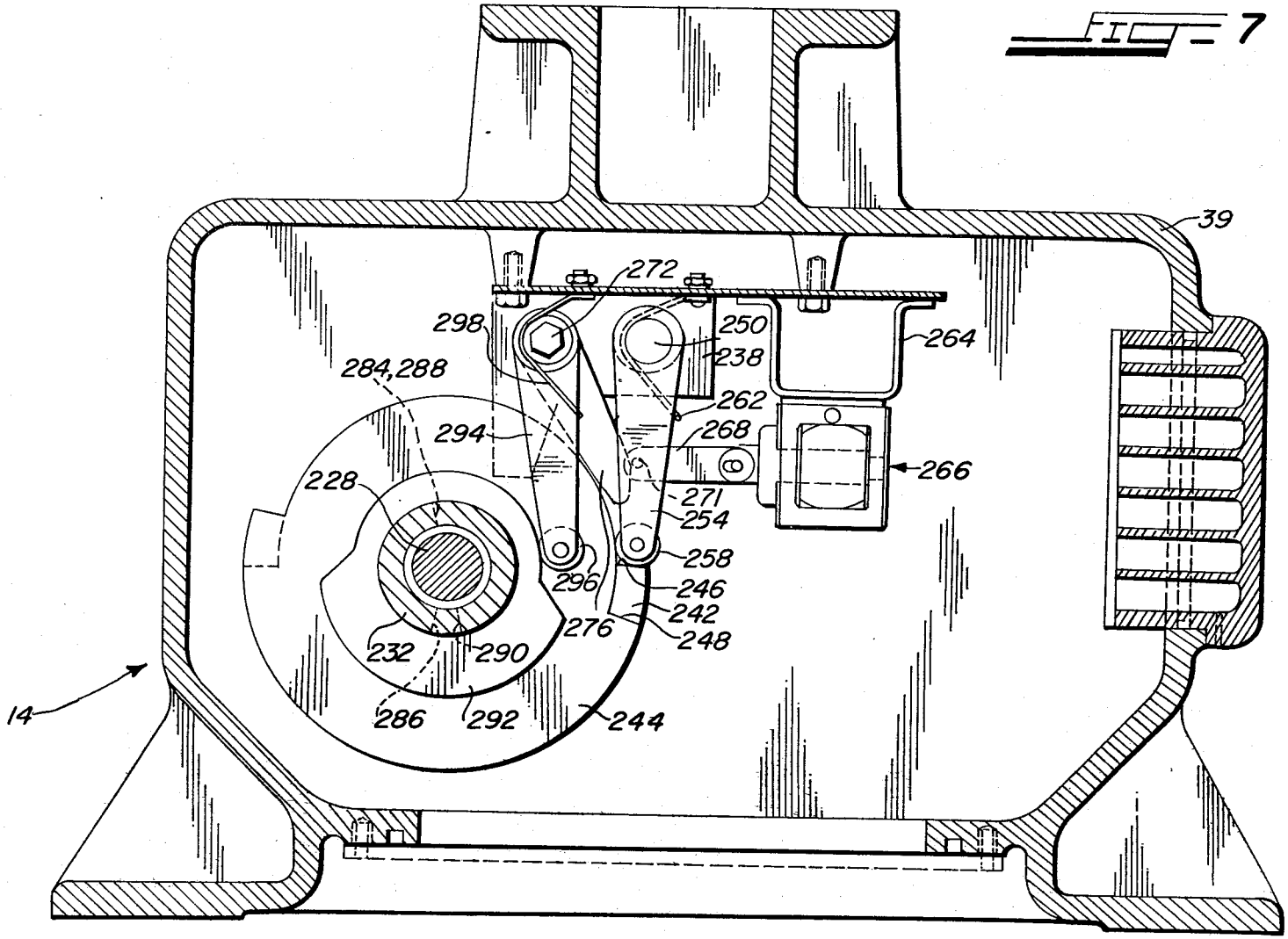
FIG. 7 is a front elevation, partially sectioned view of the shunt trip mechanism of the present invention taken generally along line 7—7 of FIG. 6, and again deleting certain elements to aid in the description of the present invention.

Turning now to FIGS. 1, 6 and 7, the shunt trip mechanism 14 of the present invention may be seen to include a pair of levers 224 and 226 on opposite ends of the shunt trip mechanism housing 39. Only the lever 226 is visible in FIG. 1. The lever 224, best seen in FIG. 6, is connected to a shaft 228 which is journalled for rotation in a wall of the shuht trip mechanism housing 39 via appropriate bearings 230. The free end of the lever 224 is pivotally connected to the lower end of the insulative strut 42 as at 231 in FIG. 6. Moreover, it is preferred, as best shown in FIG. 1, that the levers 224, 226 and the handle 126 be generally parallel in all positions thereof, regardless of the position of the strut 42. Rotation of the arm 224 is translated into rotation of the handle 126. From the perspective of FIG. 1, counterclockwise rotation of the arm 224 moves the insulative strut 42 downwardly to rotate the handle 126 counterclockwise. This counterclockwise rotation of the handle 126 effects release of the energy stored in the coil springs 66, as described above.

The lever 226 is mounted to a hollow shaft 232 journalled for rotation in an opposite wall of the shunt trip mechanism housing 39 by appropriate bearings 234. The shaft 228 extends into the hollow shaft 232 and is journalled for rotation therein by another bearing 236. Thus the shafts 228 and 232 are independently rotatable to a limited extent, as will hereinafter appear.

Acting between the shaft 228 and a support member 238 mounted to the housing 39 is a coil spring 240. The spring 240 and the shaft 228 are so related that when energy is stored in the spring 240, the shaft 228 is biased in a counterclockwise direction (FIG. 7) to bias the lever 224 for counterclockwise rotation (FIG. 1).

The shaft 228 carries a pair of cam-like members 242 and 244 mounted thereon for rotation therewith. Each cam-like member 242 and 244 has an outer peripheral compound cam surface respectively defining a stop surface 246 on the member 242 and a stop surface 248 on the cam member 244. As viewed in FIGS. 6 and 7, and considered from the aspect of counterclockwise rotation (in FIGS. 1 and 7) of the shaft 228 and the members 242 and 244, the stop surface 246 leads the stop surface 248 by approximately 15°.

Depending from and independently rotatable on a common shaft 250 held by the support member 238 are a pair of latch stop arms 252 and 254; only the arm 254 is visible in FIG. 7. The arms 252 and 254 mount respective rollers 256 and 258 at the ends thereof and are biased in a clockwise direction as viewed in FIG. 7 by respective coil springs 260 and 262 acting between the arms 252 and 254 and the support member 238. The rollers 256 and 258 are designed to abut the respective stop surfaces 246 and 248 on the respective cam-like members 242 and 244 to selectively prevent rotation of the members 242 and 244 and accordingly of the shaft 228.

FIGS. 6 and 7 show the normal position of the shaft 228, of the members 242 and 244, and of the stop surfaces 246 and 248. Specifically, the roller 256 is biased by the spring 260 against the outer surface of the cam-like member 242 and in the path of and against the stop surface 246 to prevent rotation of the member 242 by the spring 240. This accordingly prevents rotation of the shaft 228 and of the lever 224. Because the lever 224 cannot rotate, the insulative link 42 cannot move downwardly and the handle 126 cannot rotate. Accordingly, the contacts of the interrupting unit 12 are separable at this time only upon operation of the operating mechanism 13 due to the sensing of an overcurrent or fault current in the circuit 16, 18.

Attached to the housing 38 by an appropriate bracket 264 is a solenoid 266. The solenoid 266 is connectable to the relaying scheme or other appropriate sensor of the user of the device 10 for selective operation and energization thereof. The solenoid 266 contains a yoke 268 which is pulled into the body of the solenoid 266 upon energization thereof. The yoke 268 is pivotally attached to the latch stop arm 252 by a pin 270. A pin 271 is also similarly attached to the arm 254 for a purpose set forth below. The spring 260 is sufficiently strong to normally maintain the arm 252 in the normal position depicted in FIGS. 6 and 7. Energization of the solenoid 266 applies sufficient force to the yoke 268 to move the arm 252 counterclockwise as viewed in FIG. 7 (out of the plane of FIG. 6) so that the roller 256 is moved out of the path of the stop surface 246. Should this operation occur, the shaft 228 and the members 242 and 244 are rotated counterclockwise by the spring 240, as viewed in FIG. 7, approximately 15° until the stop surface 248 abuts the roller 258 on the latch stop arm 254. This abutment prevents further rotation of the shaft 228.

Because the lever 224 and the handle 126 are generally parallel and are of approximately the same length, 15° rotation of the shaft 228 effects approximately 15° rotation of the handle 126. As noted earlier, such 15° rotation of the handle 126 is sufficient to operate the one-way ratchet 202 and permit release of the energy stored in the springs 66 of the operating mechanism 13. As a consequence, should an overpressure in the transformer 16 be detected by an appropriate sensor, or should any other condition occur rendering it desirable to interrupt the circuit 16,18, appropriate signals transmitted to the solenoid 266 cause the yoke 268 to be moved rightwardly as seen in FIG. 7 thus permitting 15° rotation of the shaft 228 and the opening of the contacts in the interrupting unit 12.

Mounted to a hex or other keyed shaft 272 (visible only in FIG. 7) journalled for rotation in the support member 238 are a pair of latch-stop-arm-removing members 274 and (only the latter is visible in FIG. 7). The members 274 and 276 may be moved to respectively bear against the pins 270 271. As viewed in FIG. 7, sufficient rotation of the hex shaft 272 in the counterclockwise direction rotates both members 274 and 276 in a counterclockwise direction to ultimately remove both rollers 256 and 258 from the path of their respective stop surfaces 246 and 248, thus permitting completely free rotation of the shaft 228.

As viewed in FIG. 6, the shaft 228 has formed on the end thereof a hollow enlarged portion 282 (of about the same diameter as the shaft 232) defining a pair of dog surfaces 284 and 286. Formed on the shaft 232 is another set of dog surfaces 288 and 290 (see FIGS. 8 and 9). As shown in FIG. 9A, and as more completely described below, in the normal position of the shafts 228 and 232, the dog 284 on the shaft 228 and the dog 288 on the shaft 232 are out of engagement by a small amount, say 5°. At this time, the dog 286 on the shaft 228 and the dog 290 on the shaft 232 are separated by approximately 20°. Accordingly, some limited amount (up to 20°) counterclockwise rotation of the shaft 228 (in FIGS. 7 and 9) may occur without interference by or with the shaft 232. Specifically, should the solenoid 266 be energized, as above described, to cause the approximately 15° counterclockwise rotation of the shaft 228, such rotation will have no effect on, nor be affected by, the shaft 232.

As used in certain claims hereof, "movable member" refers to the shaft 228 including the enlarged portion 282 thereof, as well as, depending on the breadth of such claims, to the lever 224 carried by the shaft 228, the cams 242 and 244 carried by the shaft 228, the dog surfaces 284 and 286 on the portion 282, the spring 240, equivalents of all of these, and other elements or portions thereof coacting with or connecting to these enumerated elements, such as the strut 42, the handle 126 and the stop surfaces 246 and 248.

Mounted to the shaft 232 is a sector cam 292 which rotates therewith. Mounted to the hex shaft 272 is an arm 294 having a roller 296 at the end thereof. The arm 294 is biased clockwise by a spring 298 acting between the support member 238 and the arm 294 to maintain the roller 296 against the cam-like outer periphery of the sector cam 292. Thus, as viewed in FIG. 7, the spring 298 normally biases the arm 294 in a clockwise direction and also biases the members 274 and 276 in a clockwise direction away from the pins 270. On the other hand, should the shaft 232 rotate counterclockwise sufficiently to move the roller 296 and the arm 294 rightwardly due to the engagement therewith of the enlarged surface of the sector cam 292, the shaft 272 is rotated in a counterclockwise direction. This rotation causes the members 274 and 276 to rotate the arms 252 and 254 in a counterclockwise direction freeing the shaft 228 for free rotation in either direction. The conjoint action of all of these elements in freeing the shaft 228 for free rotation may be referred to as "disabling" the cams 242 and 244 and the rollers 256 and 258 so that such cannot prevent rotation of the shaft 228. As used in certain claims, then, "disabling means" refers to some or all of the elements 242, 244, 246, 248, 252, 254, 256, 258, 270, 271, 272, 274, 276, 288, 290, 292, 294, 296, and 298, along with other elements, and equivalents of all thereof, which permit free rotation of the shaft 228 following sufficient rotation of the shaft 232 to disable the rollers 256 and 258.

Referring again to FIG. 1, the handle assembly 48 comprises a crank 300 pivotally connected at one end, as at 302 to the lower end of the pipe 46. The other end of the crank 300 is attached to a shaft 304 journalled for rotation in a mounting bracket 306 attached to the pedestal 40. A hand crank 308 is attached to the shaft 304. Rotation of the handcrank 308 rotates the crank 300 and both clear the pedestal 40 so that 360° rotation of each may be achieved.

The crank 300 is both shorter than and is slightly counterclockwise of the normal position of the lever 226 to which it is connected by the pipe 46 as at 307. The lengths of the crank 300 and the lever 226 and their relative normal angular orientations are so related that if the hand crank 308 is rotated counterclockwise a full 360°, the lever 226 rotates first counterclockwise about 130°-135°, and then clockwise about the same amount to its initial position of FIG. 1. This combination of the crank 300, the pipe 46 and the lever 226 is referred to in certain claims hereof as "coupling means."

The handle assembly 48 may include locking facilities (not shown) to maintain the hand crank 308 in the position of FIG. 1. These facilities may include a padlock or the like to prevent any but authorized persons from moving the hand crank 308.

OPERATION OF SHUNT TRIP MECHANISM 14—FIGS. 8 AND 9

Figure 8:
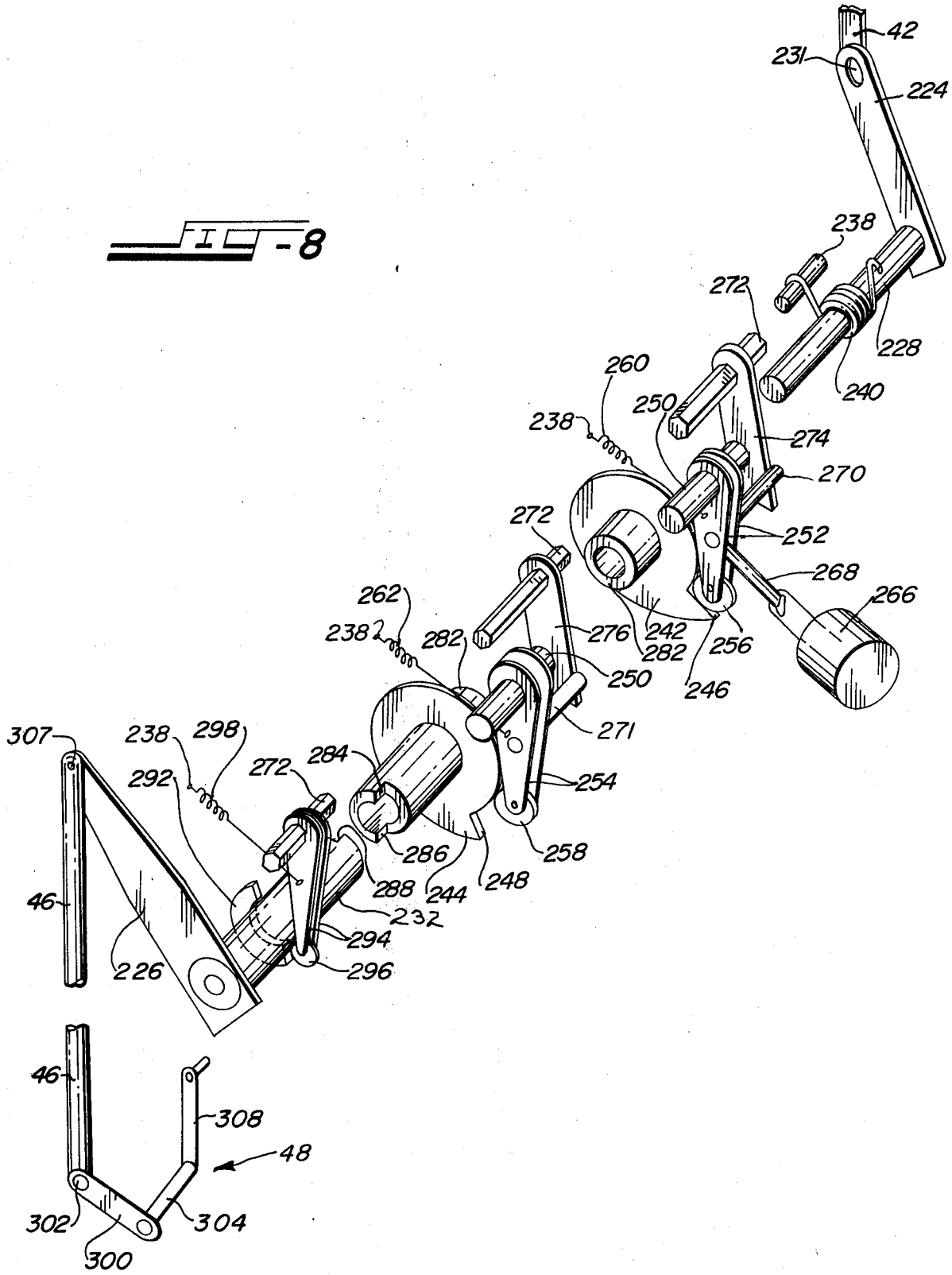
FIG. 8 is an enlarged, partially exploded, isometric or perspective schematic view of certain elements of the shunt trip mechanism depicted in FIGS. 6 and 7 according to the present invention, to better illustrate the operation thereof.
Figure 9A:
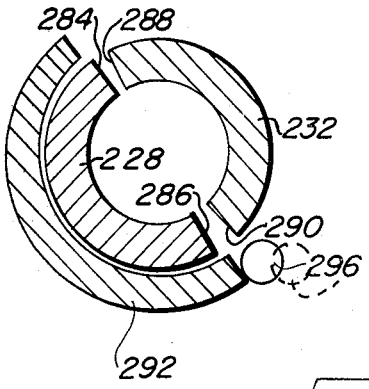
FIGS. 9A–9E are enlarged views of the certain elements of the shunt trip mechanism depicted in FIGS. 6–8 at different times during the operation thereof.

Referring now especially to FIGS. 8 and 9, the operation of the shunt trip mechanism 14 according to the present invention is now described. It should be noted that FIG. 8 is a schematic mechanical diagram of the elements depicted in FIGS. 6 and 7. Nevertheless, FIG. 8 represents in a general fashion those elements depicted in FIGS. 6 and 7, and more clearly shows the relative relationships of these elements and the manner in which the shunt trip mechanism 14 operates. FIG. 8 depicts the elements of the shunt trip mechanism 14 as it is in its normal condition. FIG. 9 is a schematic representation of the various dogs 284,286,288 and 290 on the shafts 228 and 232, showing how the relationship between these dogs changes during operation of the shunt trip mechanism 14. As can be seen from FIG. 9, and as used in certain claims hereof, the dogs 284, 286, 288 and 290 constitute a "lost-motion coupling means" which permits some amount of relative rotation between the shaft 232 and the enlargement 282. It should be noted that in FIG. 9, the schematic representation of the sector cam 292 is not shown as connected to the shaft 232. It must be realized that this cam 292 is connected to the shaft 232 and turns therewith. Also shown in FIG. 9, is a schematic representation of the roller 296 on the end of the arm 294. Further note that a certain amount of poetic license has been taken with the representation of the shafts 228 and 232 in FIG. 9. Specifically, FIG. 9 is a type of sectional view taken from FIG. 6 and looking from the left of FIG. 6 toward the right. The shaded sections representing the shafts 228 and 232 specifically represent protrusions thereon which define the dogs 284,286,288 and 290.

It will be first assumed that the operating mechanism 13 is operated to separate the contacts in the interrupting unit 12 due to operation of the shunt trip mechanism 14 of the present invention. As described earlier, should an appropriate sensor detect a predetermined condition, or should a pushbutton be closed, the solenoid 266 is operated to pull the yoke 268 thereinto, or rightwardly in FIG. 8. Such movement of the yoke 268 rotates the arm 252 counterclockwise on the shaft 250 and moves the roller 256 out of the path of the stop surface 246 on the cam 242 against the action of the spring 260. This permits the spring 240 to rotate the shaft 229 counterclockwise through approximately 15° until the roller 258 abuts the stop surface 248 on the cam 244. At this point, rotation of the shaft 228 ceases.

The 15° rotation of the shaft 228 moves the arm 224, 15° counterclockwise and accordingly the handle 126, 15° counterclockwise, because of the interconnection between the arm 224 and the handle 126 by the insulated strut 42. As described earlier, such 15° rotation of the handle 126 moves both the recocking arms 122 and the extension 220 on one of the arms 122 through approximately 15° to appropriately operate the one-way ratchet 202, ultimately effecting separation of the contacts within the interrupting unit 12 and the interruption of the circuit. Further, as described earlier, this 15° rotation does not place the recocking arms 122 in the path of the moving end member 62.

Figure 9B:
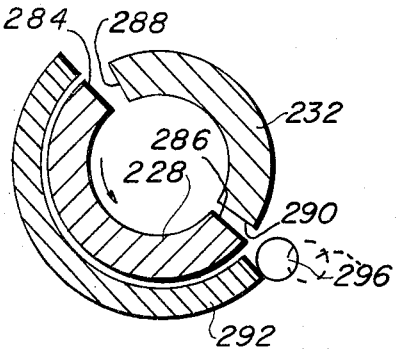

FIGS. 9*a* and 9*b* show the change in relationship between the various dogs during this time. As shown in FIG. 9*a*, the shafts 228 and 232 are normally related so that the adjacent dogs 284 and 288 are separated by about 5°, while the adjacent dogs 284 and 288 are separated by about 20°. The approximate 15° rotation of the shaft 228 by the spring 240 decreases the distance between the dogs 286 and 290 until it is about 5°, but the lack of engagement therebetween prevents the dog 290 from interfering with the rotation of the shaft 228. This latter orientation is shown in FIG. 9B, wherein the dogs 286 and 290 are separated by about 5° and the dogs 284 and 288 are separated by about 20°. Note, that the sector cam 292 does not move because the shaft 232 to which it is connected does not move. Additionally, because the sector cam 292 does not change position, the position of the roller 296 and of the arm 294 does not change.

Following such operation of the interrupting unit 12, it is necessary to manipulate the handle assembly 48 in order to reclose the interrupting unit 12. If such reclosing is desired, the locking facilities (not shown) are removed from the hand crank 308, and an operator begins to rotate the hand crank 308 in a counterclockwise direction as viewed in FIGS. 1 and 8. Rotation counterclockwise of the hand crank 308, rotates the crank 300 in a counterclockwise direction, moving the pipe 46 downwardly and rotating the arm 226 in a counterclockwise direction. Counterclockwise rotation of the arm 226 rotates the shaft 232, as, the gap between the dogs 284 and 288 is decreased. This rotation continues until the dogs 284 and 288 are engaged. During this same time, the sector cam rotates with the shaft 232. Such rotation of the sector cam 292, ultimately brings it into engagement with, and moves rightwardly, the roller 296. Such movement of the roller 296 rocks the arm 294 rightwardly, or counterclockwise, and accordingly, rotates counterclockwise the hex shaft 272. Counterclockwise rotation of the hex shaft 272 rotates the members 274 and 276 counterclockwise, until these members abut the pins 270 and 271. Further counterclockwise rotation of the members 274 and 276 moves the arms 252 and 254 counterclockwise, removing both of their rollers 256 and 258 out of the paths of their respective stop surfaces 246 and 258 on the cams 242 and 244. This action frees the shaft 228 for rotation.

Continued rotation in the counterclockwise direction of the hand crank 308 causes the arm 226 to continue to rotate counterclockwise, moving the shaft 232 and the shaft 228 counterclockwise. Such rotation of the shafts 228 and 232 continues until, because of the length and angular and relationships between the crank 300 and the arm 226, the engaged dogs 284 and 288 reached the approximate position shown in FIG. 9C. The result of these various rotations is a counterclockwise rotation of about 110° to 115° of the shaft 228.

As the shaft 228 rotates due to rotation of the hand crank 308, the arm 224 similarly rotates, moving the insulated link 42 further downwardly. The further downward movement of the insulated link 42 rotates the handle 126 further counterclockwise, thus rotating the reclosing arms 122 counterclockwise as viewed in FIG. 2 to move the spring confining tube 64 upwardly, to recompress the springs 66 and to reclose the contacts within the interrupting unit 12. Ultimately, the roller 80 re-enters the conformal surface 82 relatching the potential energy stored in the springs 66. This relatching occurs at the point in time represented by the positions of the shafts 228 and 232 shown in FIG. 9C.

Figure 9C:
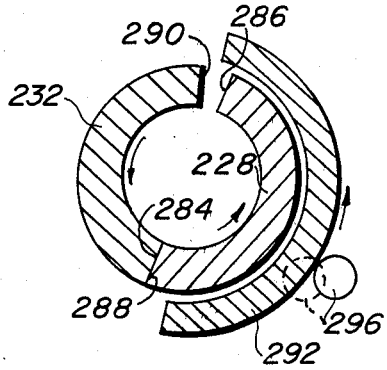
Figure 9D:
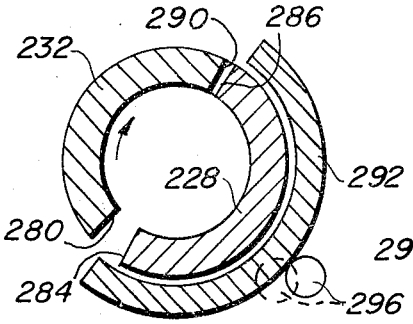

Again, due to the length and angular relationships between the crank 300 and the arm 226, continued counterclockwise rotation of the hand crank 308 now begins to move the pipe 46 upwardly toward its initial position. The initial position of such rotation is depicted in FIG. 9D, wherein the dogs 284 and 288 have become disengaged and the dogs 286 and 290 have become engaged as the shaft 232 now rotates clockwise. Such clockwise rotation of the shaft 232 and the engagement of the dogs 286 and 290 rotates the shaft 228 clockwise. Clockwise rotation of the shaft 228 rotates the arm 224 clockwise to move the insulated link 42 back up thus rotating clockwise the handle 126. This action ultimately results in the full clockwise rotation of the resetting arms 122 (FIG. 2) back to their initial position and the positioning of the extension 220 in its normal position with respect to the one-way ratchet 202. The clockwise rotation of the shaft 228 also recharges the spring 240 for a subsequent operation of the shunt trip mechanism 14. Thus, as the dogs 286 and 290 remain in engagement, and the shafts 228 and 232 rotate clockwise, the relative position of the dogs is depicted first in FIG. 9D, and then in FIG. 9E.

Figure 9E:
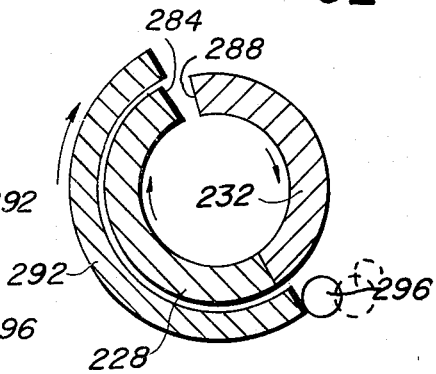

The shaft 228 is rotated sufficiently clockwise to ensure that the stop surface 246 on the cam 242 clears the position at which it is engaged by the roller 256. Because the shaft 232 has rotated clockwise, the sector cam 292 is ultimately disengaged from the roller 296 and the spring 298 returns the arm 294 to its normal position. Such normal positioning of the arm 294, rotates the hex shaft 272 to disengage the pins 270 and 271 from the members 274 and 276. Thus, the spring 260 is free to pull the arm 252 toward the cam 242 so that the roller 256 abuts the stop surface 246. This point in time is depicted by FIG. 9E. Upon returning the hand crank 308 to its initial position, the shaft 228 remains stationary and the shaft 232 rotates slightly counterclockwise, as shown in going from FIG. 9E to FIG. 9A.

Next, it will be assumed that the interrupting unit 12 is operated due to an operation of the operating mechanism 13, which is not due to an operation of the shunt trip mechanism 14. In this event, the contacts within the interrupting unit 12 separate to interrupt the circuit as described above and as more completely described in the co-pending patent application of Opfer and Vojta. The fact that contact opening was initiated by the operating mechanism 13 alone, means that the handle 126 resides in its normal position as shown in FIGS. 1 and 2, even though the contacts within the interrupting unit 12 have been opened. In this event, the same reclosing sequence is initiated in the shunt trip mechanism 14 due to manipulation of the handcrank 308, except that the time sequence is represented by going from FIG. 9A directly to FIG. 9C. Specifically, because operation of the interrupting unit 12 was not initiated by the 15° counterclockwise rotation of the shaft 228, following such operation of the interrupting unit 14, the shafts 228 and 232 and their respective dogs continue to have the relationships shown in FIG. 9A. Subsequently, closing of the contacts in the interrupting unit is initiated by an initial 5° of counterclockwise rotation of the shaft 232 until the dogs 284 and 288 engage, which is in turn followed by the approximate 130°–135° of counterclockwise rotation of the shaft 228 as shown in FIG. 9C. Note, in the event of this resetting sequence, the counterclockwise rotation of the arm 294 by the sector cam 292, removes both rollers 256 and 258 from the path of their respective stop surfaces 246 and 248. Otherwise, the resetting sequence following an operation of the interrupting unit 12, due solely to the operating mechanism 13, is exactly as described above. It should be noted that the initial 5° separation between the dogs 284 and 288, or whatever amount of separation is selected, provides sufficient rotation for the shaft 232 so that the sector cam 292 moves the arm 294 sufficiently to move the rollers 256 and 258 out of the paths of the respective stop surfaces 246 and 248.

Lastly, operation of the operating mechanism 13 may be initiated by rotation of the hand crank 308 rather than by a sensor effecting operation of the solenoid 226. Specifically, and assuming that the energy of the springs 66 is latched, initial counterclockwise rotation of the hand crank 308, until the dogs 284 and 288 engage, causes the sector cam 292 to rotate the arm 294 counterclockwise, freeing the shaft 228 for rotation as described above. Continued rotation of the shaft 232 rotates the shaft 228 counterclockwise a sufficient amount to rotate the arm 224 and the handle 126 counterclockwise to operate the one-way ratchet 202, thus opening the contacts in the interrupting unit 12. Following this, continued counterclockwise rotation of the hand crank 308 effects resetting or reclosing of the interrupting unit 12 as described above.

CONCLUSION

Described above has been a novel shunt trip mechanism 14 for use in conjunction with an interrupting device 10, including an operating mechanism 13 of the type described in the co-pending application of Opfer and Vojta. As should be obvious, the shunt trip mechanism 14 of the present invention provides the user of the device 10 with numerous options. First, the user may elect to utilize the device 10 with only the operating mechanism 13 and without the shunt trip mechanism 14. In this event, the device serves a protection function for the transformer 16, by appropriately responding to fault currents or overcurrents in the circuit 16, 18. Following the building block approach, the user of the device 10 may also elect to incorporate the shunt trip mechanism 14 of the present invention thereinto. Thus, the user obtains parallel circuit interruption ability. Specifically, the circuit may be interrupted by appropriate operation of the operating mechanism 13 in response to fault currents or overcurrents in the circuit 16,18, as well as by operation of the shunt trip mechanism 14. This latter operation may, as noted above, be initiated by the energization of the solenoid 266 by any appropriate sensor or even a pushbutton. Lastly, the user may opt to purchase the device 10 with a simplified operating mechanism 13 in which the solenoid 108 and various "intelligence" therewithin is not present. Such a device 10 would be used in conjunction with the shunt trip mechanism 14 of the present invention for operation of the interrupting unit 12. In this event, the appropriate sensor which initiates operation of the solenoid 266, may or may not be related to the current levels in the circuits 16,18.

Although the device 10 is disclosed as located in a single-phase of a three-phase system, it should be clear that each phase would include one such device 10. Accordingly, if the solenoids 266 of all shunt trip mechanism 14 are energized for any reason, all three phases will be interrupted. The interrupting units 12 of all three devices 10 are as capable of interrupting load and magnetizing currents as they are of interrupting fault currents or overcurrents, and the devices 10 may be therefore used for load switching.

While the present invention has been described with respect to specific embodiments thereof, it should be clear to those having skill in the art, that various shapes, sizes, relationships and configurations may be changed or altered without departing from the scope hereof.

What is claimed is:

1. A shunt trip mechanism for use with a high-voltage circuit interrupting device, the device being of the type having an operating mechanism at line potential which selectively latches stored energy to maintain contacts closed or releases the stored energy to open the contacts in response to a predetermined condition of the current in the circuit; the shunt trip mechanism comprising:

first means at line potential (a) for selectively effecting release of the stored energy by the operating mechanism to open the contacts and (b) for both reclosing the opened contacts and restoring the energy upon such reclosing, the first means being operable independently of the operating mechanism; and second means at ground potential insulated from the operating mechanism and the first means for operating the first means to (a) cause the release of the stored energy in response to the occurrence of a predetermined event and (b) reclose the open contacts and restore the energy in response to manual manipulation thereof, whether the stored energy was released by operation of the operating mechanism or of the first and second means.

2. A shunt trip mechanism according to claim 1, wherein:

the first means comprises movable means having a normal position and being movable in a first direction out of the normal position, and ratchet means for releasing the stored energy in response to movement in the first direction of the movable means out of its normal position at a time when the contacts are closed, opening of the contacts by the operating mechanism not affecting the position of the movable means.

3. A shunt trip mechanism according to claim 2, wherein:

the first means further comprises means for reclosing the contacts in response to movement in the first direction of the movable means out of its normal position at a time after the contacts have been opened by either the ratchet means or the operating mechanism.

4. A shunt trip mechanism according to claim 3, wherein:

the first means further comprises means for biasing the movable means to its normal position, and wherein the ratchet means permits free movement of the movable means back to its normal position after movement in the first direction.

5. A shunt trip mechanism according to claim 4, wherein:

movement of the movable means in the first direction to which movement the ratchet means responds is less than the movement to which the reclosing means responds, so that release of the stored energy by the operating mechanism simultaneously with movement in the first direction of the movable means does not interfere with the opening of the contacts.

6. A shunt trip mechanism according to claim 4, wherein:

the movable means comprises a rotatable reclosing arm rotatable in the first direction out of the normal position stud means on the reclosing arm for reclosing the contacts, an extension on the arm for effecting release of the stored energy by the ratchet means, and insulated means for connecting the reclosing arm to the second means.

7. A shunt trip mechanism according to claim 1, wherein:

the first means comprises movable means having a normal position and being movable a first predetermined amount in a first direction at a time when the contacts are closed for releasing the stored energy and a second predetermined amount of movement in the first direction after the contacts have been opened by either the movable means or the operating mechanism for reclosing the contacts, the second predetermined amount being greater than the first predetermined amount.

8. A shunt trip mechanism according to claim 7, wherein:

the second means comprises a movable member having a first normal position, a second intermediate position, and a third position;

insulated means for interconnecting the movable member and the movable means so that (a) the movable means is in its normal position when the movable member is in its first position, (b) the movable means moves in the first direction the first predetermined amount when the movable member moves to its second position, and (c) the movable means moves in the first direction the second predetermined amount when the movable member moves to its third position;

third means responsive to the occurrence of the predetermined event for moving the movable member from its first to its second position;

the position of the movable member being unaffected by opening of the contacts by the operating mechanism.

9. A shunt trip mechanism according to claim 8, wherein:

the second means further comprises manually operable means for moving the movable member to its third position from either its first or its second position.

10. A shunt trip mechanism according to claim 9 wherein:

the third means comprises:

first cam means for maintaining the movable member in its first position absent the occurrence of the predetermined event and regardless of the opening of the contacts by the operating mechanism.

means for biasing the movable member for movement from its first to its second position, and fourth means responsive to the occurrence of the predetermined event for rendering the first cam means incapable of maintaining the movable member in its first position, so that the biasing means discharges to move the movable member to its second position.

11. A shunt trip mechanism according to claim 10, wherein:

the third means further comprises:

second cam means for maintaining the movable member in its second position following movement thereto.

12. A shunt trip mechanism according to claim 11, wherein:

the third means further comprises:

disabling means responsive to operation of the manually operable means for disabling both cam means to permit free movement of the movable member to its third position from either its first or second position by the manually operable means.

13. A shunt trip mechanism according to claim 12, which further comprises:

lost-motion coupling means interconnecting the manually operable means and the movable member for permitting the movable member to move from its first to its second position without affecting the condition of the manually operable means.

14. A shunt trip mechanism according to claim 12, wherein:

the manually operable means comprises:

a rotatable, hand-graspable handle, and a coupling means for interconnecting the handle and the movable member so that 360° unidirectional rotation of the handle (a) first moves the movable member to its third position from either its first or second position, and then (b) moves the movable member back to its first position, simultaneously recharging the biasing means.

15. A shunt trip mechanism according to claim 12, wherein:

the movable member is a first rotatable shaft.

16. A shunt trip mechanism according to claim 15, wherein the firt cam means comprises:

a first cam on the first shaft, a stop surface on the first cam, and a first spring-biased arm normally held against the first cam in the path of its stop surface to maintain the first shaft in the first position.

17. A shunt trip mechanism according to claim 16, wherein:

the fourth means comprises:

electro-magnetic means for moving the first arm out of the path of the first cam stop surface to permit rotation of the first shaft to the second position.

18. A shunt trip mechanism according to claim 17, wherein the second cam means comprises:

a second cam on the first shaft, a stop surface on the second cam, and a second spring-biased arm normally held against the second cam in the path of its stop surface to maintain the first shaft in the second position.

19. A shunt trip mechanism according to claim 18, wherein:

the disabling means comprises:

lever means for moving both arms out of the paths of the respective stop surfaces on both cams to permit free shaft rotation to the third position.

20. A shunt trip mechanism according to claim 19, wherein:

the manually operable means comprises:

a second shaft; and the disabling means further comprises:

a sector cam on the second shaft, last-motion coupling means interconnecting the shafts for permitting limited rotation of the second shaft before the first shaft is rotated thereby regardless of whether the first shaft is in its first or second position, and means responsive to the position of the sensor cam for effecting movement by the lever means of both arms out of the paths of the stop surfaces when the second shaft undergoes limited rotation in a direction effective to rotate the first shaft to its third position.

21. A shunt-trip mechanism according to claim 20, wherein:

the lever means is a pair of levers, mutually rockable to simultaneously move both arms out of the paths of the stop surfaces; and the sector-cam-position-responsive means comprises:

a follower for the sector cam, and a common shaft mounting the levers and the cam follower.

22. A shunt trip mechanism according to claim 21, wherein:

the last motion coupling means permits the first shaft to rotate from its first to its second position without affecting the position of the second shaft, and;

the manually operable means comprises:

a rotatable, hand-graspable handle, and coupling means interconnecting the handle and the second shaft so that 360° unidirectional rotation of the handle (a) first rotates the first shaft to its third position from either its first or second position, and then (b) rotates the first shaft back to its first position, simultaneously recharging the biasing means.

23. An improved shunt trip mechanism for use with a circuit interrupting device of the type having, all at line potential, (a) a pair of normally engaged, separable contacts located in an arc-extinguishing medium and (b) an operating mechanism which includes (i) a stored energy source for separating the contacts; (ii) a latch for preventing release of the stored energy; and (iii) means responsive to the circuit current for tripping the latch to release the stored energy and separate the contacts; the shunt trip mechanism being of the type which is electrically isolated from the interrupting device, the stored energy source, the latch and the tripping means, and being responsive to selected events for releasing the stored energy to separate the contacts independently of the latch tripping means; wherein the improvement comprises:

a movable member having a normal first position;

means for biasing the member out of the first position;

electrically insulative means interconnecting the member and the latch for operating the latch to release the stored energy in response to movement of the member out of the first position, the position of the movable member being unaffected by release of the stored energy due to operation of the tripping means;

first means for holding the movable member in the first position against the biasing means; and means for rendering the first holding means inoperative in response to the occurrence of a selected event.

24. A shunt trip mechanism according to claim 23, which further comprises:

a second means for holding the movable member in a second position after its movement out of the first position;

a ground level, movable handle;

last-motion coupling means for coupling the handle to the movable member so that the movable member is free to move from the first to the second position without movement of, or interference by, the handle;

means responsive to a predetermined amount of handle movement for rendering both holding means inoperative so that movement of the handle moves the movable member out of the first or second position to a third position; and means responsive to movement of the movable member to the third position for reclosing the contacts and restoring energy to the source.

* * * * *